United States Patent [19]

Ohtaki et al.

[11] Patent Number: 4,599,630

[45] Date of Patent: Jul. 8, 1986

[54] TWO-COLOR THERMOSENSITIVE RECORDING MATERIAL

[75] Inventors: Kazumi Ohtaki; Hiroshi Sakamoto, both of Numazu, Japan

[73] Assignee: Ricoh Company, Ltd., Tokyo, Japan

[21] Appl. No.: 669,838

[22] Filed: Nov. 9, 1984

[30] Foreign Application Priority Data

Nov. 15, 1983 [JP] Japan ..... 58-214747
Nov. 15, 1983 [JP] Japan ..... 58-214748

[51] Int. Cl.[4] ..... B41M 5/18; B41M 5/22

[52] U.S. Cl. ..... 346/204; 346/205; 346/208; 346/216; 346/217; 346/220; 346/221; 346/226; 427/152

[58] Field of Search ..... 346/204, 205, 208, 209, 346/226, 206, 214, 216, 217, 220–225; 427/150–152

[56] References Cited

U.S. PATENT DOCUMENTS 4,311,750 1/1982 Kubo et al. ..... 427/150

FOREIGN PATENT DOCUMENTS 0139290 10/1980 Japan ..... 346/204
0040588 4/1981 Japan ..... 346/204

*Primary Examiner*—Bruce H. Hess
*Attorney, Agent, or Firm*—Oblon, Fisher, Spivak, McClelland & Maier

[57] ABSTRACT

A two-color thermosensitive recording material using leuco dyes is disclosed, which is capable of forming two different colors when heated at different temperatures, black or blackish color at a low temperature and another color at a high temperature, comprising a support material, a high-temperature color-forming material overlaying the support material, a decolorization layer overlaying the high-temperature color-forming layer, and a low-temperature color-forming layer overlaying the decolorization layer, and when necessary, an intermediate layer interposed between the decolorization layer and the low-temperature color-forming layer, the decolorization layer containing an aliphatic amine or a morpholine derivative of the formula of

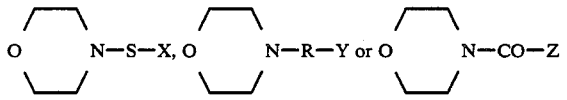

which are fully defined in the specification, and the low-temperature color-forming layer containing as a color developer a thiourea derivatives of the formula,

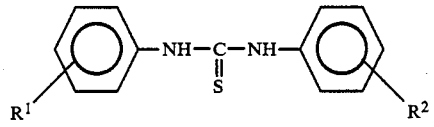

which is fully defined in the specification.

14 Claims, No Drawings

TWO-COLOR THERMOSENSITIVE RECORDING MATERIAL

BACKGROUND OF THE INVENTION

The present invention relates to a two-color thermosensitive recording material comprising two temperature-sensitive color-forming compositions including leuco dyes which become differently colored when heated at different temperatures.

A conventional thermosensitive recording material comprises a support material and a thermosensitive coloring layer formed on the support material, on which thermosensitive coloring layer colored images can be formed by application of heat thereto. For the heat application for image formation, a thermal head is in general use. In such a conventional thermosensitive recording material, there are usually employed in the thermosensitive coloring layer a colorless or light-colored leuco dye containing a lactone ring, a lactam ring or a spiropyran ring, and a color developer which induces color in the leuco dye upon application of heat by the reaction with the leuco dye, since it is capable of yielding clear images with reduced fogging.

Because of the capability of forming colored images by simple application of heat, such thermosensitive recording materials are used widely, not only for copying books and documents, but also for recording output information from computers, facsimile apparatus, telex and other information transmission and measuring instruments. Depending upon the recording mode, it will be more convenient if it is allowed to record particular data in a different color from the remainder on a thermosensitive recording material, in order to display the particular data more distinctly from remainder.

Recently, many trials have been made to attain recording with multiple colors by applying heat at different temperatures or by applying different quantities of thermal energy. Accordingly, a variety of multi-color thermosensitive recording materials have been proposed.

A conventional multi-color thermosensitive recording sheet comprises a support material and two thermosensitive color-forming layers overlaying the support material, which color-forming layers are colored in different colors upon application of different thermal energies thereto respectively. One layer is referred to as, for example, a high-temperature color-forming layer and the other is referred to as, for example, a low-temperature color-forming layer. The low-temperature color-forming layer forms color at a low temperature, while the high-temperature color-forming layer does not form color at all at the low temperature, but forms color at a high temperature which is higher than the low temperature, and the two colors are different from each other.

Such conventional multi-color thermosensitive recording sheets can be roughly classified into the following two types.

In one type, when a high-temperature color-forming layer is colored by application of heat at a high temperature, the color developed in the high-temperature color-forming layer is mixed with the color already developed in a low-temperature color-forming layer, so that a color different from the color in the low-temperature layer is produced in the high-temperature color-forming layer.

In the other type, when the high-temperature color-forming layer is colored, the color in the low-temperature color-forming layer is decolorized by a decolorizing agent, so that only the high-temperature color-forming layer is colored without the color of the low-temperature color-forming layer being mixed therewith.

Specific examples of the former type are disclosed, for instance, in Japanese Patent Publications No. 49-69, No. 49-4342 and No. 49-27708, and Japanese Laid-Open Patent Applications No. 48-86543 and No. 49-65239.

Specific examples of the latter type are disclosed, for instance, in Japanese Patent Publications No. 50-17865, No. 50-17866, No. 51-29024 and No. 51-87542, and Japanese Laid-Open Patent Applications No. 50-18048 and No. 53-47843.

The former type has the shortcoming that the practically developable color systems are limited to such combinations that the colors developed at high temperature can overcome the color developed at low temperature, such as red (low temperature) — black (high temperature), and blue (low temperature) — black (high temperature).

In the latter type, there are no particular limitations to the combination of colors. However, when leuco dyes capable of yielding black color are employed in the low-temperature color-forming layer, a decolorizing agent capable of completely decolorizing the color of such leuco dyes has not been discovered, although higher aliphatic alcohols, polyether, polyethylene glycol derivatives, nitrogen-containing compounds such as acetamide, stearamide, phthalonitrile, and amine derivatives such as guanidine derivatives are proposed. The result is that the separation of the color in the high temperature color-forming layer from the color in the low temperature color-forming layer is insufficient and the color combination that can be used in practice is substantially limited to a combination of blue (low temperature) — red (high temperature). For this reason, a two-color thermosensitive recording material capable of yielding the combination of black (low temperature) — red (high temperature) has not been proposed, although this combination is most practical for office use and general use, since it is desirable to produce most frequently used black at low temperature.

SUMMARY OF THE INVENTION

It is therefore an object of the present invention to provide a two-color thermosensitive recording material using leuco dyes capable of forming a clear black or blackish color at low temperature which does not discolor with time, and another color which is not mixed with the color developed at low temperature.

This object of the present invention can be attained by a two-color thermosensitive recording material comprising at least a support material, a high-temperature color-forming layer overlaying the support material, a decolorization layer overlaying the high-temperature color-forming layer, and a low-temperature color-forming layer overlaying the decolorization layer.

The high-temperature color-forming layer contains a leuco dye and a color developer which is capable of inducing color formation in the leuco dye upon application of heat thereto.

The decolorization layer contains at least one decolorizing agent selected from the group consisting of morpholine derivatives represented by the following formulae (Ia), (Ib) or (Ic) and aliphatic amines, which decolorizing agent is capable of decolorizing the color developed in the low-temperature color-forming layer when heated to a predetermined temperature.

(Ia)

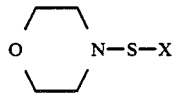

wherein X represents

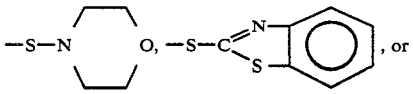

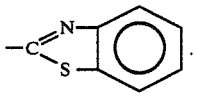

(Ib)

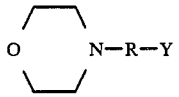

wherein Y represents

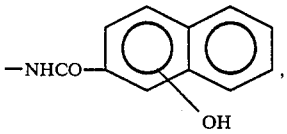

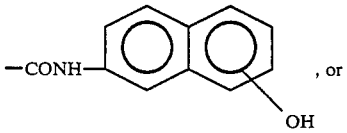

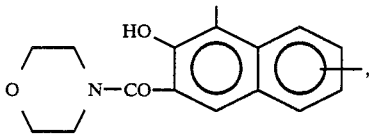

and R represents alkylene.

(Ic)

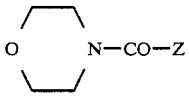

wherein Z represents

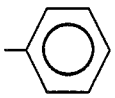

or higher alkyl.

The low-temperature color-forming layer contains a leuco dye and a thiourea derivative represented by the following formula (II), which serves as a color developer capable of inducing color formation in the leuco dye:

(II)

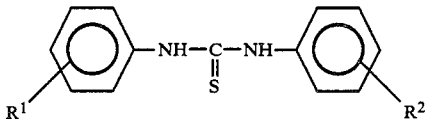

wherein $R^1$ and $R^2$ each represent hydrogen, halogen, trifluoromethyl, or alkyl having 1 to 4 carbon atoms.

Furthermore, when necessary, an intermediate layer comprising as the main components a thermo-fusible material and a water-soluble polymeric binder agent can be interposed between the decolorization layer and the low-temperature color-forming layer, whereby a two-color thermosensitive recording material which is improved in that the images developed in the low-temperature color-forming layer do not discolor with time.

DETAILED DESCRIPTION OF THE PREFERRED EMBODIMENTS

Specific examples of the decolorizing agents for use in the present invention, which are covered by the previously given formulae (Ia), (Ib) and (Ic) are as follows:

(1)

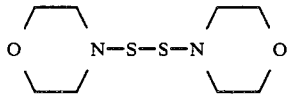

(2)

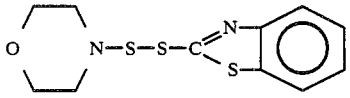

(3)

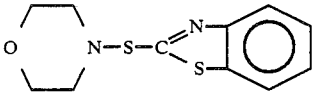

(4)

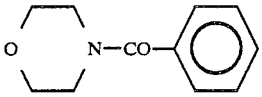

(5)

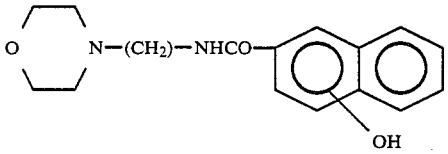

(6)

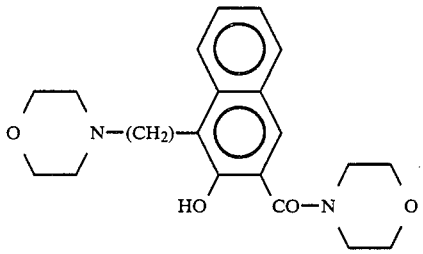

As the aliphatic amines employed as decolorizing agents in the present invention, thermo-fusible amines having a melting point ranging from about 45° C. to about 200° C. are preferably employed.

Specific examples of such aliphatic amines are stearylamine, behenyl amine, distearylamine, di-n-dodecylamine, triethylenediamine, octamethylenediamine and stearyldiethanolamine.

The leuco dyes for use in the present invention are those employed conventionally in the field of thermosensitive recording materials. They can be used alone or in combination. Examples of such leuco dyes for use in the present invention are triphenylmethane-type leuco compounds, fluoran-type leuco compounds, phenothiazine-type leuco compounds, auramine-type leuco compounds and spiropyran-type leuco compounds. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran, 3-diethylamino-7-chlorofluoran, 3-diethylamino-7-methylfluoran, 3-diethylamino-7,8-benzfluoran,
3-diethylaminobenzo [α]fluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran
2-[N-83'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)-fluoran,
3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino) fluoran,
3-pyrrolidino-7-(di-p-chlorophenyl)methylaminofluoran,
3-diethylamino-5-chloro-7-8α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-8α-phenylethylamino)fluoran,
3-diethylamino-7-piperidinofluoran,
2-chloro-3-(N-methyltoluidino)-7-(p-n-butylanilino)-fluoran,
3-diethylamino-7-(o-chloroanilino)fluoran,
3-dibutylamino-7-(o-chloroanilino)fluoran,
3-dimethylamino-7-(o-chloroanilino)fluoran,
3-dipropylamino-7-(o-chloroanilino)fluoran,
3-dimethylamino-7-(o-fluoroanilino)fluoran,
3-diethylamino-7-(o-fluoranilino)fluoran,
3-dipropylamino-7-(o-fluoroanilino)fluoran,
3-dibutylamino-7-(o-fluoroanilino)fluoran,
3-N-mthyl-N-amylamino-6-methyl-7-anilinofluoran,
3--
-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)-fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(N-benzyl-N-cyclohexylamino)-5,6-benzo-7-α-naphthylamino-4'-bromofluoran, and
3-diethylamino-6-methyl-7-mesidino-4',5'-benzofluoran.

As mentioned previously, these leuco dyes can be used alone or in combination.

Of the above mentioned leuco dyes, the following leuco dyes are particularly suitable for use in the high-temperature color-forming layer:

3-diethylamino-7-chlorofluoran,
3-diethylamino-6-methyl-7-chlorofluoran,
3-cyclohexylamino-6-chlorofluoran, and
3-diethylaminobezo[α]fluoran.

When an intermediate layer comprising as the main components a thermo-fusible material and a water-soluble polymeric binder against is not interposed between the decolorization layer and the low-temperature color-forming layer, the leuco dyes represented by the following general formula (III) are preferable for use in the low-temperature color-forming layer:

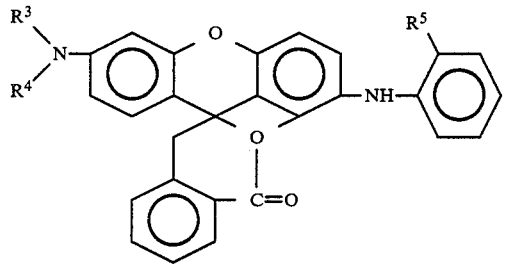

(III)

wherein $R^3$ and $R^4$ each represent alkyl having 1 to 4 carbon atoms and $R^5$ represents chlorine or fluorine.

Specific examples of the leuco dyes represented by the above formula (III) are as follows:

3-dimethylamino-7-(o-chloroanilino)fluoran,
3-diethylamino-7-(o-chloroanilino)fluoran,
3-dipropylamino-7-(o-chloroanilino)fluoran,
3-dibutylamino-7-(o-chloroanilino)fluoran,
3-dimethylamino-7-(o-fluoroanilino)fluoran,
3-diethylamino-7-(o-fluoroanilino)fluoran,
3-dipropylamino-7-(o-fluoroanilino)fluoran, and
3-dibutylamino-7-(o-fluoroanilino)fluoran.

As the color developers for use in the high-temperature coloring layer in the present invention, the following can be employed:

4-hydroxyphenoxide, 4-t-butylphenol, 4-hydroxyacetophenone, resorsinol, α-naphthol, thymol, β-naphthol, catechol, hydroquinone, pyrogallol, phloroglucinol, phloroglucinolcarboxylic acid, 4,4'-sec-butylidenediphenol, 4,4'-isopropylidene-bis(2-t-butylphenol), 4-t-octylcatechol, 4'-sec-butylidenediphenol, 2,2'-dihydroxydiphenyl, 2,2'-methylene-bis(4-methyl-6-t-butylphenol), 2,2-bis(4'-oxyphenyl)propane (Bisphenol A), and 3,5-xylenol.

In the low-temperature color-forming layer, in addition to at least one of the previously mentioned leuco dyes, at least one of the thiourea derivatives represented by the previously mentioned formula (II) is contained, which serves as a color developer for the leuco dye.

Specific examples of the thiourea derivatives are as follows:

N,N'-diphenylthiourea, N-p-ethylphenyl-N'-phenylthiourea, N-p-butylphenyl-N'-phenylthiourea, N,N'-di-m-chlorophenylthiourea, N,N'-di-p-chlorophenylthiourea, N,N'-di-m-trifluoromethylphenylthio-urea, and N,N'-di-m-methylphenylthiourea.

In the present invention, a wide variety of conventional binder agents can be employed for binding and supporting the above-mentioned leuco dyes and color developers.

Examples of the binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid three-dimensional copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acryl-type copolymer.

In the present invention, when necessary, auxiliary additives which are conventionally employed in the thermosensitive recording materials of this type, for example, fillers, surface active agents and thermo-fusible materials, can be added to the above mentioned leuco dyes and color developers.

Specific examples of the fillers are calcium carbonate, silica, zinc oxide, titanium oxide, aluminum hydroxide, zinc hydroxide, barium sulfate, clay, talc, surface-treated inorganic powder, for example, of calcium and silica, and powder of organic materials, such as urea-formaldehyde resin, styrene/methacrylic acid copolymer and polystyrene.

Specific examples of the thermo-fusible materials are higher fatty acids, esters, amides and metal salts of higher fatty acids, a variety of waxes, condensates of aromatic carboxylic acids and amines, benzoic acid phenyl esters, higher straight-chain glycols, 3,4-epoxydialkyl hexahydrophthalate, higher ketones, and other thermo-fusible organic compounds having a melting point in the range of about 50° C. to about 200° C.

The intermediate layer comprising as the main components a thermo-fusible material and a water-soluble polymeric binder agent is interposed between the decolorization layer and the low-temperature color-forming layer. This layer serves to prevent the migration of the decolorizing agent from the decolorization layer to the low-temperature color-forming layer and the migration of a dye which is colored at a low temperature from the low-temperature color-forming layer to the decolorization layer.

Furthermore, the thermo-fusible material contained in the intermediate layer works effectively when the decolorizing agent is fused for decolorizing the low-temperature color-forming layer by application of thermal energy higher than that required for coloring the low-temperature color-forming layer. Therefore, it is preferable that the thermo-fusible materials to be contained in the intermediate layer have a melting point higher than that of the low-temperature coloring layer. As the thermo-fusible materials for the intermediate layer, most conventional thermo-fusible materials having a melting point of about 60° C. to about 150° C. can be employed.

Specific examples of such thermo-fusible materials are amide derivatives, such as stearamide, methylolstearamide, ethylenebisstearamide, N-stearylcarbamoylebenzene, terephthalic acid monomethylstearamide ($CH_3OOC\text{-}C_6H_4\text{-}CONHC_{18}H_{35}$); aromatic carboxylic acid derivatives, such as dimethylterephthalate, benzoic acid p-chlorophenylester, benzoic acid p-cyanophenylester and methylbezoic phenylester; and aromatic hydrocarbons, such as 2,6-diisopropylnaphthalene, 2,6-diisoproplylnaphthalene, phenanthrene, terphenyl, triphenylmethane, acenaphthene, fluorene and fluoranthrene.

Specific examples of the water-soluble polymeric binder agents are polyvinyl alcohol, polyacrylamide, hydroxyethylcellulose, methylcellulose, carboxymethylcellulose, starch, starch derivatives, isobutylene—maleic anhydride alkali salt and styrene—maleic anhydride alkali salt.

Referring to the following examples, the present invention will now be explained in detail.

EXAMPLE 1

Dispersions A-1, B-1, C-1 and D-1 were prepared by dispersing the components of each dispersion in a ball mill for 24 hours.

| | Parts by Weight |
|---|---|
| Dispersion A-1 | |
| 3-dibutylamino-7-chloroanilino-fluoran (Black) | 20 |
| 10% aqueous solution of hydroxy-ethylcellulose | 20 |
| Water | 60 |
| Dispersion B-1 | |
| 3,3'-dichlorophenylthiourea | 15 |
| Calcium carbonate | 5 |
| 10% aqueous solution of polyvinyl alcohol | 20 |
| Water | 60 |
| Dispersion C-1 | |
| 3-diethylamino-7-chlorofluoran (Red) | 20 |
| 10% aqueous solution of hydroxy-ethylcellulose | 20 |
| Water | 60 |
| Dispersion D-1 | |
| Bisphenol A | 15 |
| Stearamide | 10 |
| 10% aqueous solution of hydroxy-ethylcellulose | 5 |
| Calcium carbonate | 10 |
| Water | 70 |

10 parts by weight of the above prepared Dispersion A-1, 40 parts by weight of Dispersion B-1 and 30 parts by weight of water were mixed well, so that a low-temperature color-forming layer formation liquid was prepared.

Further, 10 parts by weight of the Dispersion C-1, 30 parts by weight of Dispersion D-1 and 20 parts by weight of water were mixed well, so that a high-temperature color-forming layer formation liquid was prepared.

A decolorization layer formation liquid was prepared by dispersing the following components in a ball mill:

| | Parts by Weight |
|---|---|
| 4,4'-dithiomorpholine | 25 |
| 10% aqueous solution of polyvinyl alcohol | 10 |
| Water | 50 |

The thus prepared high-temperature color-forming layer formation liquid was first coated on a sheet of commercially available high quality paper (with a basic weight of about 50 g/m$^2$) with a deposition of 5.5 g/m$^2$ when dried, whereby a high-temperature color-forming layer was formed on the high quality paper. The decolorization layer formation liquid was then coated on the high-temperature color-forming layer with a deposition of 2.5 g/m$^2$ when dried, whereby a decolorization layer was formed on the high-temperature color-forming layer. Finally, the low-temperature color-forming layer formation liquid was coated on the decolorization layer with a deposition of 1.0 g/m$^2$ when dried, whereby a two-color thermosensitive recording material No. 1 according to the present invention was prepared.

EXAMPLE 2

The procedure of Example 1 was repeated except that 3,3'-dichlorophenylthiourea in Dispersion B-1 was replaced with 3,3'-difluorophenylthiourea, whereby a two-color thermosensitive recording material No. 2 according to the present invention was prepared.

EXAMPLE 3

The procedure of Example 1 was repeated except that 3-dibutylamino-7-chloroanilinofluoran in Dispersion A-1 was replaced with 3-(N-methyl-N-cyclohexylamino)-6-methyl-7-anilinofluoran, whereby a two-color thermosensitive recording material No. 3 according to the present invention was prepared.

COMPARATIVE EXAMPLE

The procedure of Example 1 was repeated except that 3,3'-dichlorophenylthiourea in the dispersion B-1 was replaced with Bisphenol A, whereby a comparative two-color thermosensitive recording material was prepared.

On the thus prepared two-color thermosensitive recording materials No. 1 through No. 3 and the comparative two-color thermosensitive recording material, thermal printing was performed by use of a heat gradient test apparatus (made by Toyo Seiki Co., Ltd.) with the temperature of its thermal head changed from 70° C. to 150° C., and with a pressure of 2 kg/cm$^2$ applied to the recording materials for 1 second.

The result was that the two-color thermosensitive recording materials No. 1 through No. 3 yielded clear-cut color-separated images without the images developed in the low-temperature color-forming layer being discolored during the formation of the images in the high-temperature color-forming layer. Comparatively, the recording materials No. 1 and No. 2 yielded better images than the recording material No. 3 in terms of the color separation.

In contrast to this, the comparative two-color thermosensitive recording material did not yield clear images at all and the color separation was poor, since the images developed in the low-temperature color-forming layer were discolored during the formation of the images in the high-temperature color-forming layer.

EXAMPLE 4

Dispersions A-2, B-2, C-2 and D-2 were prepared by dispersing the components of each dispersion in a ball mill for 24 hours.

| | Parts by Weight |
|---|---|
| Dispersion A-2 | |
| 3-(N—ethyl-N—amylamino)-6-methyl-7-anilino-fluoran (Black) | 20 |
| 10% aqueous solution of hydroxyethylcellulose | 20 |
| Water | 60 |
| Dispersion B-2 | |
| 3,3'-dichlorophenylthiourea | 12 |
| Stearamide | 6 |
| Calcium carbonate | 12 |
| 10% aqueous solution of polyvinyl alcohol | 30 |
| Water | 40 |
| Dispersion C-2 | |
| 3-diethylamino-7-chlorofluoran (Red) | 20 |
| 10% aqueous solution of hydroxyethylcellulose | 20 |
| Water | 60 |
| Dispersion D-2 | |
| Bisphenol A | 12 |
| Ethylenebisstearamide | 6 |
| Calcium carbonate | 9 |
| 10% aqueous solution of polyvinyl alcohol | 30 |
| Water | 43 |

10 parts by weight of the above prepared Dispersion A-2, 60 parts by weight of Dispersion B-2 and 30 parts by weight of water were mixed well, so that a low-temperature color-forming layer formation liquid was prepared.

Further, 10 parts by weight of Dispersion C-2, 60 parts by weight of Dispersion D-2 and 30 parts by weight of water were mixed well, so that a high-temperature color-forming layer formation liquid was prepared.

A decolorization layer formation liquid was prepared by dispersing the following components in a ball mill:

| | Parts by Weight |
|---|---|
| 4,4'-dithiodimorpholine | 20 |
| 10% aqueous solution of polyvinyl alcohol | 20 |
| Water | 60 |

An intermediate layer formation liquid was prepared by dispersing the following components in a ball mill:

| | Parts by Weight |
|---|---|
| Stearamide | 5 |
| 10% aqueous solution of polyvinyl alcohol | 50 |
| Polycarboxylic acid type surface active agent | 0.5 |

-continued

| | Parts by Weight |
|---|---|
| Water | 44.5 |

The thus prepared high-temperature color-forming layer formation liquid was first coated on a sheet of commercially available high quality paper (with a basis weight of about 50 g/m$^2$) with a deposition of 4 g/m$^2$ when dried, whereby a high-temperature color-forming layer was formed on the high quality paper.

The decolorization layer formation liquid was then coated on the high-temperature color-forming layer with a deposition of 2.5 g/m$^2$ when dried, whereby a decolorization layer was formed on the high-temperature coloring layer.

The intermediate layer formation liquid was then coated on the decolorization layer with a deposition of 1.5 g/m$^2$ when dried.

Finally, the low-temperature color-forming layer formation liquid was coated on the intermediate layer with a deposition of 3 g/m$^2$ when dried, whereby a two-color thermosensitive recording material was prepared. This was then subjected to calendering, thereby making the surface thereof smooth so as to have a surface degree of 500 to 1500 seconds, whereby a two-color thermosensitive recording material No. 4 according to the present invention was prepared.

EXAMPLE 5

Example 4 was repeated except that 3,3'-dichlorophenylthiourea is Dispersion B-2 was replaced with 3,3'-difluorophenylthiourea, the 4,4'-dithiodimorpholine in the decolorization layer formation liquid was repaced with octamethylenediamine, and the stearamide in the intermediate layer formationliquid was replaced with terephthalic acid monomethylstearamide, whereby a two-color thermosensitive recording material No. 5 according to the present invention was prepared.

EXAMPLE 6

The procedure of Example 4 was repeated except that the intermediate layer was excluded, whereby a two-color thermosensitive recording material No. 6 according to the present invention was prepared.

The thus prepared two-color thermosensitive recording materials No. 4, No. 5 and No. 6 according to the present invention were subjected to coloring tests to produce a black color at a low temperature and a red color at a high temperature by use of a printing test machine for facsimile apparatus including a thin-film thermal head under the conditions that the thremal energy applied to the thermal head was 0.6 W/dot, the pressure applied to a platen was 3 kg/A-4 size and a pulse width of the applied energy was changed.

Furthermore, the two-color thermosensitive recording materials No. 4, No. 5 and No. 6 having the developed colored images thereon were preserved at room temperature for one month to see the preservability of the color (Black) developed at low temperature in each two-color thermosensitive recording material.

The results are shown in the following table.

| | Coloring Test | | Preservability of Color (Black) Developed at |
|---|---|---|---|
| | At Low-Temp. (Black) | At High Temp. (Red) | low temperature (1 month later) |
| Example 4 | Density 1.10 at 1.0 mj/dot | Density 0.9 at 2.0 mj/dot | 1.10 → 0.98 |
| Example 5 | Density 1.05 at 1.0 mj/dot | Density 0.90 at 2.2 mj/dot | 1.05 → 0.91 |
| Example 6 | Density 1.12 at 1.0 mj/dot | Density 0.95 at 1.8 mj/dot | 1.12 → 0.30 |

0.6 W/dot × (Pulse Width msec) = mj/dot

As can be seen from the above table, the two-color thermosensitive recording materials according to the present invention yielded black images at low temperatures and red images at high temperatures with high density, and by interposing the intermediate layer between the decolorizing layer and the low-temperature coloring layer, the preservability of the colors developed in the low-temperature coloring layer can be significantly improved.

What is claimed is:

1. In a two-color thermosensitive recording material capable of forming two different colors when heated at different temperatures, comprising a support material, a high-temperature color-forming layer formed on said support material, a decolorization layer overlaying said high-temperature color-forming layer, and a low-temperature color-forming layer overlaying said decolorization layer, said high-temperature color-forming layer being capable of forming color when heated at a predetermined coloring temperature, said low-temperature color-forming layer being capable of forming color which is different from the color formed by said high-temperature color-forming layer when heated at a predetermined coloring temperature which is lower than said coloring temperature for said high-temperature color-forming layer, and said decolorization layer being capable of decolorizing the color developed in said low-temperature color-forming layer when heated up to a predetermined temperature for preventing the color developed in said low-temperature color-forming layer being mixed with the color developed in said high-temperature color-forming layer, the improvement wherein said high-temperature color-forming layer comprises a first leuco dye and a color developer capable of inducing color formation in said first leuco dye upon application of heat thereto, said decolorizing layer comprises a decolorizing agent selected from the group consisting of aliphatic amines and morpholine derivatives represented by general formula (Ia), (Ib) and (Ic),

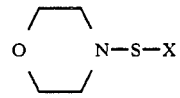

(Ia)

wherein X represents

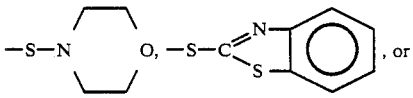

, or

-continued

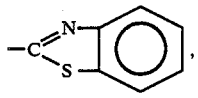

(Ib)

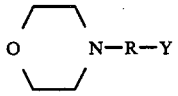

wherein Y represents

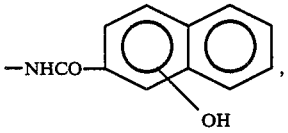

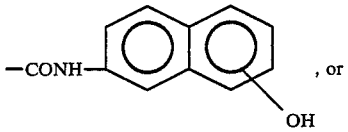

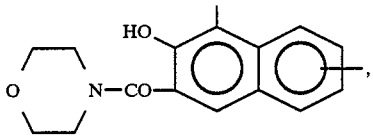

and R represents alkylene, (Ic)

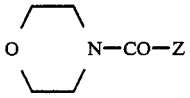

wherein Z represents

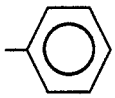

or higher alkyl, said low-temperature color-forming layer comprises a second leuco dye and a thiourea derivative of general formula (II) serving as a color developer capable of inducing color formation in said second leuco dye upon application of heat thereto, (II)

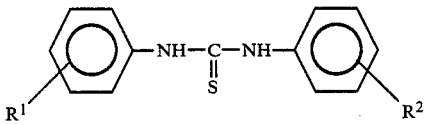

wherein $R^1$ and $R^2$ each represent hydrogen, halogen, trifluoromethyl or alkyl having 1 to 4 carbon atoms.

2. A two-color thermosensitive recording material as claimed in claim 1, further comprising an intermediate layer comprising as the main components a thermo-fusible material and a water-soluble polymeric binder agent between said decolorization layer and said low-temperature color-forming layer.

3. A two-color thermosensitive recording material as claimed in claim 2, wherein said first leuco dye employed in said high-temperature color-forming layer and said second leuco dye employed in said low-temperature color-forming layer each are selected from the group consisting of triphenylmethane-type leuco compounds, fluoran-type leuco compounds, phenothiazine-type leuco compounds, auramine-type leuco compounds and spiropyran-type leuco compounds.

4. A two-color thermosensitive recording material as claimed in claim 2, wherein said first leuco dye in said high-temperature color forming layer and said second leuco dye in said low-temperature color forming layer each are selected from the group consisting of:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide, 3,3-bis(p-dimethylaminophenyl)-6-chlorophthalide,
3,3-bis(p-dibutylaminophenyl)-phthalide,
3-cyclohexylamine-6-chlorofluoran,
3-dimethylamino-5,6-dimethylfluoran,
3-diethylamino-7-chlorofluoran,
3-diethylamino-7-methylfluoran,
3-diethylamino-7,8-benzfluoran,
3-diethylaminobenzo[α]fluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3′-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-(2′-hydroxy-4′-diethylaminophenyl)-3-(2′-methoxy-5′-methylphenyl)phthalide,
3-(2′methoxy-4′-dimethylaminophenyl)-3-(2′-hydroxy-4′-chloro-5′-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-diethylamino-7-(o-chloroanilino)fluoran,
3-dibutylamino-7-(o-chloroanilino)fluoran,
3-dimethylamino-7-(o-chloroanilino)fluoran,
3-dipropylamino-7-(o-chloroanilino)fluoran,
3-dimethylamino-7-(o-fluoranilino)fluoran,
3-diethylamino-7-(o-fluoroanilino)fluoran,
3-dipropylamino-7-(o-fluoroanilino)fluoran,
3-dibutylamino-7-(o-fluoroanilino)fluoran,
3-N-methyl-N-amylamino-6-methyl-7-anilinofluoran, 3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)-fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(N-benzyl-cyclohexylamino)-5,6-benzo-7-α-naphthylamino-4'-bromofluoran, and
3-diethylamino-6-methyl-7-methyl-7mesidino-4',5'-benzofluoran.

5. A two-color thermosensitive recording material as claimed in claim 2, wherein said thermo-fusible material contained in said intermediate layer is selected from the group consisting of amide derivatives and aromatic hydrocarbons having a melting point ranging from 60° C. to 120° C.

6. A two-color thermosensitive recording material as claimed in claim 2, wherein said thermo-fusible material contained in said intermediate layer is selected from the group consisting of stearamide, methylolstearamide, ethylenebisstearamide, N-stearylcarbamoylebenzene, terephthalic acid monomethylstearamide, dimethylterephthalate, benzoic acid p-chlorophenyl ester, benzoic acid p-cyanophenyl ester and methylbezoic phenyl ester, 2,6-diisopropylnaphthalene, phenanthrene, terphenyl, triphenylmethane, acenaphthene, fluorene and fluoranthene.

7. A two-color thermosensitive recording material as claimed in claim 2, wherein said water-soluble polymeric binder agent is selected from the group consisting of polyvinyl alcohol, polyacrylamide, hydroxyethylcellulose, methylcellulose, carboxymethylcellulose, starch, starch derivatives, isobutylene-maleic anhydride copolymer alkali salt and styrene/maleic anhydride copolymer alkali salt.

8. A two-color thermosensitive recording material as claimed in claim 1, wherein said first leuco dye employed in said high-temperature color-forming layer and said second leuco dye employed in said low-temperature color-forming layer each are selected from the group consisting of triphenylmethane-type leuco compounds, fluoran-type leuco compounds, phenothiazine-type leuco compounds, auramine-type leuco compounds and spiropyran-type leuco compounds.

9. A two-color thermosensitive recording material as claimed in claim 1, wherein said first leuco dye in said high-temperature color forming layer and said second leuco dye in said low-temperature color-forming layer each are selected from the group consisting of:
3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylaminobenzo[α]fluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)-fluoran,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-diethylamino-7-(o-chloroanilino)fluoran,
3-dibutylamino-7-(o-chloroanilino)fluoran,
3-dimethylamino-7-(o-chloroanilino)fluoran,
3-dipropylamino-7-(o-chloroanilino)fluoran,
3-dimethylamino-7-(o-fluoroanilino)fluoran,
3-diethylamino-7-(o-chloroanilino)fluoran,
3-dipropylamino-7-(o-fluoroanilino)fluoran,
3-dibutylamino-7-(o-fluoroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)-fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(N-benzyl-cyclohexylamino)-5,6-benzo-7-α-naphthylamino-4'-bromofluoran, and
3-diethylamino-6-methyl-7-methyl-7mesidino-4',5=-benzofluoran.

10. A two-color thermosensitive recording material as claimed in claim 1, wherein said second leuco dye in said low-temperature color forming layer is a leuco dye represented by the formula,

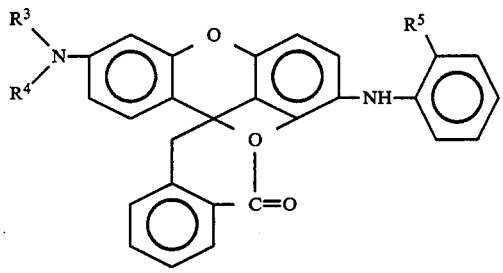

wherein $R^3$ and $R^4$ each represent alkyl having 1 to 4 carbon atoms and $R^3$ represents chlorine or fluorine atom.

11. A two-color thermosensitive recording material as claimed in claim 1, wherein said color developer in said high-temperature color forming layer is selected from the group consisting of 4-hydroxyphenoxide, 4-t-butylphenol, 4-hydroxyacetophenone, resorcinol, α-naphthol, thymol, β-naphthol, catechol, hydroquinone, pyrogallol, phloroglucinol, phloroglucinolcarboxylic acid, 4,4'-sec-butylidenediphenol, 4,4'-isopropylidene-bis(2-t-butylphenol), 4-t-octylcatechol, 4'-sec-butylidenediphenol, 2,2'-dihydroxydiphenyl, 2,2'-methylene-bis(4-methyl-6-t-butylphenol), 2,2-bis(4'-oxyphenyl)propane (Bisphenol A) and 3,5-xylenol.

12. A two-color thermosensitive recording material as claimed in claim 1, wherein said aliphatic amine contained in said decolorizing layer are thermo-fusible aliphatic amines having a melting point in the range of from 45° C. to 200° C.

13. A two-color thermosensitive recording material as claimed in claim 12, wherein said aliphatic amine is selected from the group consisting of stearylamine, behenyl amine, distearylamine, di-n-dodecylamine, triethylenediamine, octamethylenediamine and stearyldiethanolamine.

14. A two-color thermosensitive recording material as claimed in claim 1, wherein said thiourea derivative is selected from the group consisting of N,N'-diphenylthiourea, N-p-ethylphenyl-N'-phenylthiourea, N-p-butylphenyl-N'-phenylthiourea, N,N'-di-m-chlorphenylthiourea, N,N'-di-p-chlorophenylthiourea, N,N'-di-m-trifluoromethylphenylthiourea and N,N'-di-m-methylphenylthiourea.

* * * * *